US007314442B2

(12) United States Patent
Shimizu et al.

(10) Patent No.: US 7,314,442 B2
(45) Date of Patent: Jan. 1, 2008

(54) CENTRIFUGE ASSEMBLY PORTION, CENTRIFUGE, HAVING DRIVE ARRANGEMENT ACCESS OPENING AND COVER

(75) Inventors: Takahiro Shimizu, Toyota (JP); Yuki Shimizu, Hitachinaka (JP); Hiroshi Hayasaka, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/520,639

(22) Filed: Sep. 14, 2006

(65) Prior Publication Data

US 2007/0060462 A1 Mar. 15, 2007

(30) Foreign Application Priority Data

Sep. 14, 2005 (JP) ..... P2005-266716

(51) Int. Cl.
*B04B 7/02* (2006.01)
*B04B 9/02* (2006.01)

(52) U.S. Cl. ..... 494/60; 494/84

(58) Field of Classification Search ..... 494/16–21, 494/43, 60, 82–84; 68/23.3; 210/360.1–380.2; 74/572.4

See application file for complete search history.

(56) References Cited

U.S. PATENT DOCUMENTS

| | | | | |
|---|---|---|---|---|
| 2,585,107 | A * | 2/1952 | Geldhof | 68/23.3 |
| 3,860,166 | A * | 1/1975 | Anderson | 494/13 |
| 4,022,375 | A | 5/1977 | Suovaniemi et al. | |
| 2007/0060462 | A1 * | 3/2007 | Shimizu et al. | 494/60 |

FOREIGN PATENT DOCUMENTS

JP 2-305595 * 12/1990

* cited by examiner

*Primary Examiner*—Charles E. Cooley
(74) *Attorney, Agent, or Firm*—Antonelli, Terry, Stout & Kraus, LLP

(57) ABSTRACT

A centrifuge includes a frame, a motor, a output shaft, a rotational shaft, and a belt. The frame has a bottom portion. The motor is disposed in the frame to generate a driving force. The output shaft extends from the motor and has an end positioned in proximity to the bottom portion. The rotational shaft is disposed in the frame and has one end positioned in proximity to the bottom portion. The belt is supported on the end of the output shaft and the one end of the rotational shaft. The bottom portion is formed with an opening that opposes at least part of the belt.

10 Claims, 3 Drawing Sheets

CENTRIFUGE ASSEMBLY PORTION, CENTRIFUGE, HAVING DRIVE ARRANGEMENT ACCESS OPENING AND COVER

BACKGROUND OF THE INVENTION

The present invention relates to a centrifuge, and particularly to a tabletop centrifuge that is installed on a testing bench or the like.

Centrifuges with various structures have been proposed over the years. One such conventional centrifuge disclosed in U.S. Pat. No. 4,022,375 includes a motor base that is supported on the base of a frame via dampers. A motor and a shaft unit are juxtaposed on the motor base, while a driving force transmitting mechanism is disposed beneath the motor base. A belt in the driving force transmitting mechanism transmits the driving force of the motor to the shaft unit.

SUMMARY OF THE INVENTION

However, since the motor, motor base, and shaft unit are all disposed above the belt in the centrifuge described above, the parts above the belt must be exposed when inspecting tension in the belt or replacing the belt. This requires a complex operation that can be time-consuming.

In view of the foregoing, it is an object of the present invention to provide a centrifuge capable of facilitating operations to check belt tension and to replace the belt, and capable of reducing the time required for such operations.

This and other object of the present invention will be attained by a centrifuge including a frame, a motor, a output shaft, a rotational shaft, and a belt. The frame has a bottom portion. The motor is disposed in the frame to generate a driving force. The output shaft extends from the motor and has an end positioned in proximity to the bottom portion. The rotational shaft is disposed in the frame and has one end positioned in proximity to the bottom portion. The belt is supported on the end of the output shaft and the one end of the rotational shaft. The bottom portion is formed with an opening that opposes at least part of the belt.

DESCRIPTION OF THE PREFERRED EMBODIMENTS

Figure 1:
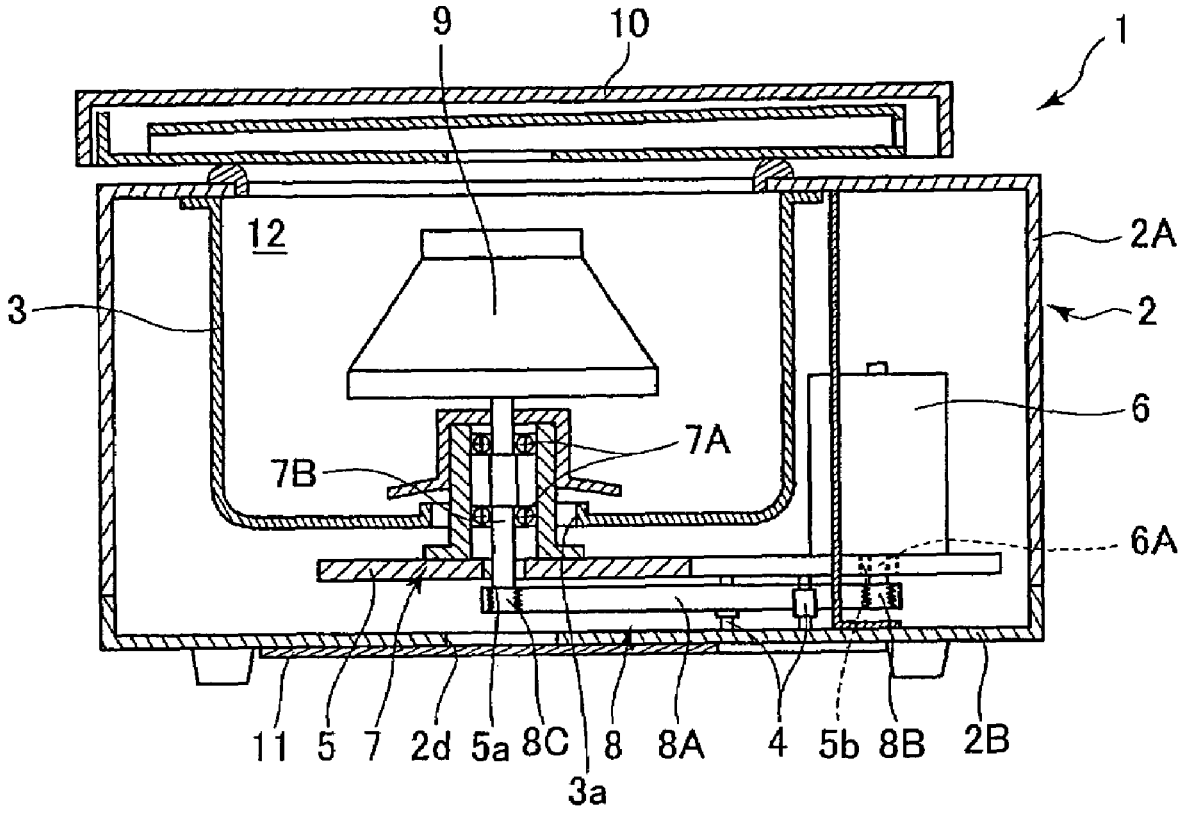
FIG. 1 is a schematic diagram showing the general structure of a centrifuge according to a preferred embodiment of the present invention.
Figure 2:
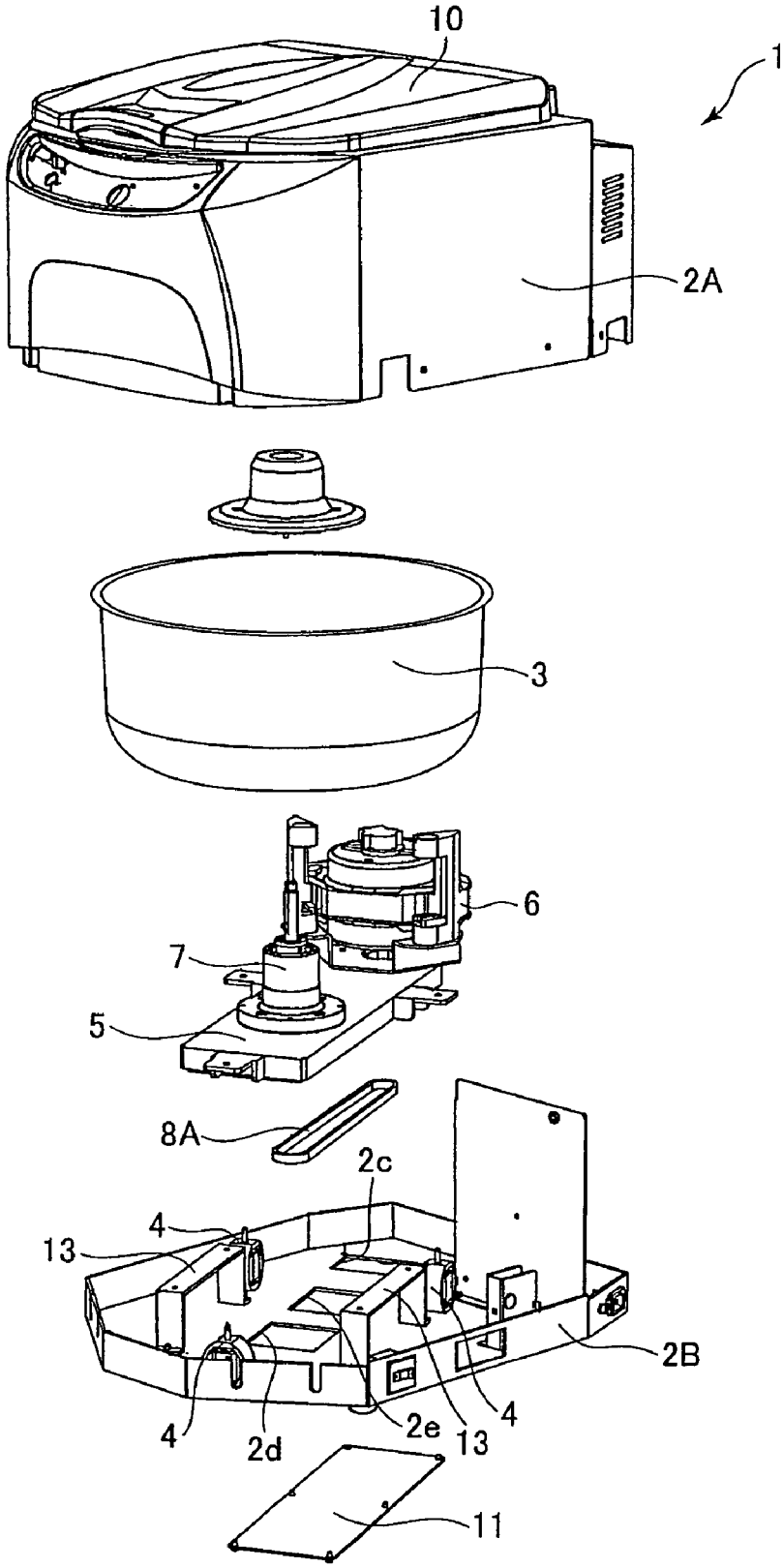
FIG. 2 is an exploded perspective view of the centrifuge according to the preferred embodiment.

A centrifuge 1 according to a preferred embodiment of the present invention will be described with reference to FIGS. 1 and 2. The centrifuge 1 primarily includes a frame 2, a bowl 3, a plurality (three in the preferred embodiment) of dampers 4, a motor base 5, a motor 6, a shaft unit 7, a driving force transmitting mechanism 8, and a rotor 9. The frame 2 constitutes the outer frame of the centrifuge 1 and has a box shape with an open top. The frame 2 includes an upper frame 2A, and a base 2B. A cover 10 is provided on the top of the upper frame 2A and is capable of opening and closing over the opening in the top. As shown in FIG. 2, first through third openings 2*c*-2*e* are formed in the base 2B. A cover 11 is mounted on the lower side of the base 2B by screws or the like so as to be capable of being detached therefrom. The cover 11 is positioned to block the first through third openings 2*c*-2*e* for interrupting the flow of air between the inside of the frame 2 and the external air.

The bowl 3 is formed in a cylindrical shape having a bottom. A shaft unit insertion hole 3*a* is formed in the bottom portion of the bowl 3. The bowl 3 is disposed inside the frame 2 and is fixed to and supported on the frame 2 via bowl mounting parts 13. The bowl 3 defines a rotor chamber 12. The three dampers 4 are arranged in a triangular shape on the base 2B. The motor base 5 is substantially box-shaped with an open bottom and is supported on the dampers 4 mounted on the base 2B. For explanatory purposes, the motor base 5 is shown in a simplified plate shape in FIG. 1. A portion of the motor base 5 is positioned opposite the bowl 3. A shaft through-hole 5*a* is formed in the portion of the motor base 5 opposing the bowl 3. An output shaft through-hole 5*b* is formed in a portion of the motor base 5 that does not oppose the bowl 3.

The motor 6 is disposed on a side of the bowl 3 on the portion of the motor base 5 that does not oppose the bowl 3. The motor 6 has an output shaft 6A that penetrates the output shaft through-hole 5*b* and extends toward the base 2B. The output shaft 6A functions to output a driving force of the motor 6. The shaft unit 7 is disposed in the portion of the motor base 5 that opposes the bowl 3. The shaft unit 7 penetrates the shaft unit insertion hole 3*a* so that the top portion of the shaft unit 7 is positioned inside the rotor chamber 12. The shaft unit 7 includes two bearings 7A, and a vertically extended drive shaft 7B rotatably supported in the bearings 7A. The drive shaft 7B penetrates the shaft through-hole 5*a*, with one end positioned inside the rotor chamber 12 and the other end positioned below the motor base 5.

The driving force transmitting mechanism 8 is disposed below the motor base 5 and includes the belt 8A, a first pulley 8B, and a second pulley 8C. The first pulley 8B is coaxially fixed to the lower end of the output shaft 6A, and the second pulley 8C is coaxially fixed to the lower end of the drive shaft 7B. The belt 8A is mounted over the first and second pulleys 8B and 8C. The driving force transmitting mechanism 8 having this configuration transmits a driving force from the motor 6 to the drive shaft 7B. Further, the first and second pulleys 8B and 8C are positioned opposite the first and second openings 2*c* and 2*d* formed in the base 2B. A portion of the belt 8A corresponding to an approximate center region between the first and second pulleys 8B and 8C opposes the third opening 2*e*. The rotor 9 is connected to the upper end of the drive shaft 7B and is capable of rotating together with the drive shaft 7B for separating a target material from a sample.

Next, the operations of the centrifuge 1 having the aforementioned structure will be described. The motor 6 begins operating when a user pushes a start switch (not shown) on the centrifuge 1. At this time, the motor 6 drives the output shaft 6A to rotate, and the driving force is transmitted from the output shaft 6A to the drive shaft 7B via the belt 8A. As the drive shaft 7B rotates, the rotor 9 rotates in association therewith and separates a target material from the sample in the rotor 9. The rotation of the rotor 9 produces vibrations in the shaft unit 7, motor base 5, and motor 6, but the dampers 4 can attenuate these vibrations.

As described above, the third opening 2*e* is formed in the base 2B in a region opposing the center region of the belt 8A between the first and second pulleys 8B and 8C. Therefore, an operator can easily inspect the tension in the belt 8A through the third opening 2*e* after removing the cover 11, without exposing any components positioned above the belt 8A (in other words, without disassembling the body of the centrifuge 1), thereby reducing the time required for inspecting the belt tension. Here, tension in the belt is checked using an ultrasound tensiometer to measure the sound generated when plucking the belt 8A with a finger. The tension can also be checked by pushing the belt 8A or by using a spring to push or pull the belt with a fixed force while measuring displacement in the belt. Further, the first and second openings 2*c* and 2*d* are formed in the base 2B at positions opposing the first and second pulleys 8B and 8C. Therefore, an operator can easily replace the belt 8A through the first and second openings 2*c* and 2*d* after removing the cover 11, without exposing parts positioned above the belt 8A, thereby shortening the time required for the replacement operation.

Figure 3:
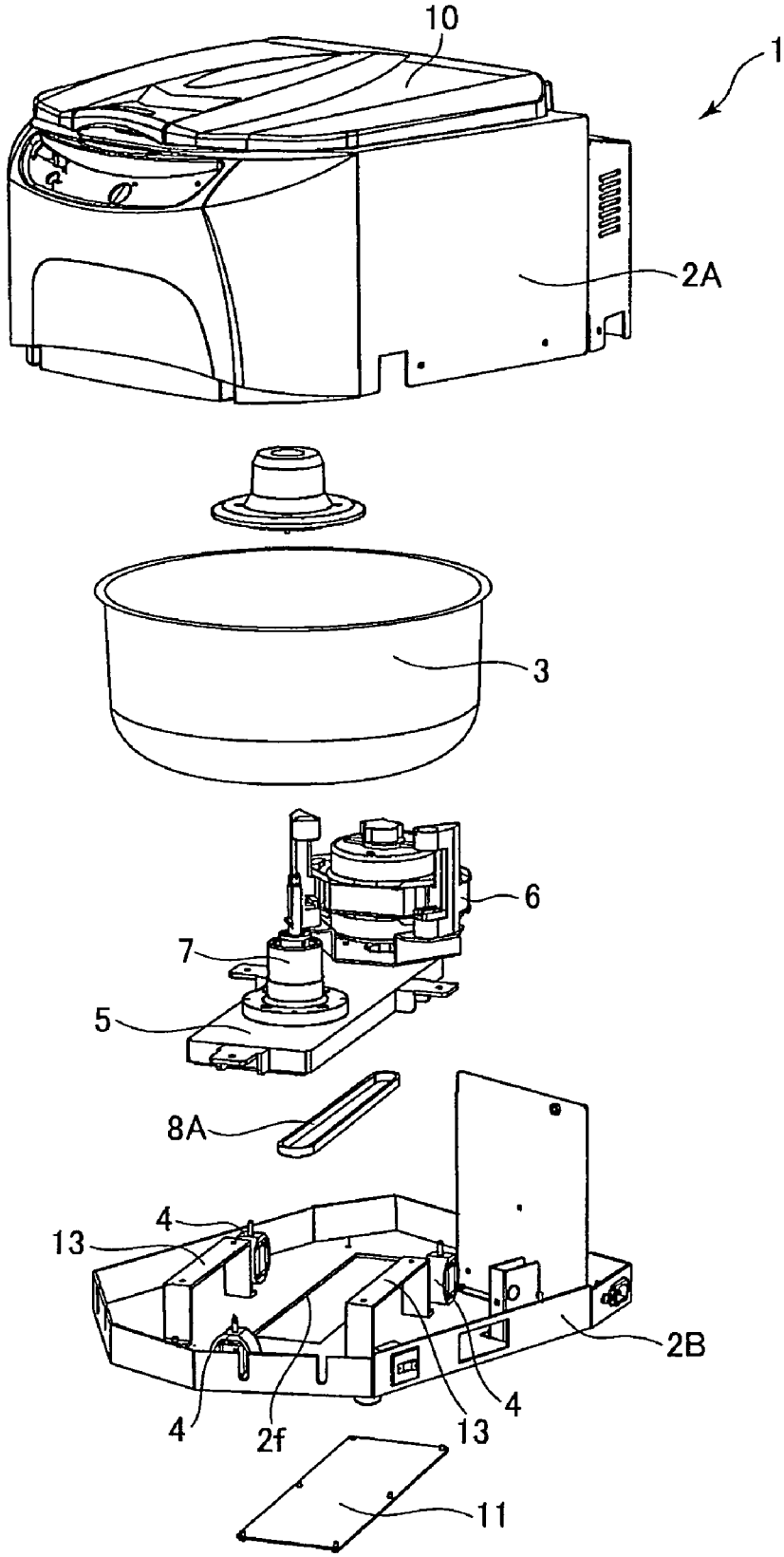
FIG. 3 is an exploded perspective view of a centrifuge according to a variation of the preferred embodiment.

While the invention has been described in detail with reference to specific embodiments thereof, it would be apparent to those skilled in the art that many modifications and variations may be made therein without departing from the spirit of the invention, the scope of which is defined by the attached claims. For example, while three openings 2*c*-2*e* are formed in the base 2B in the preferred embodiment described above, it is also possible to form a single opening 2*f* in a region of the base 2B opposing the entire belt 8A, as shown in FIG. 3. This construction can obtain the same effects described above for the preferred embodiment. Further, while three openings 2*c*-2*e* are formed in the base 2B in the preferred embodiment described above, only the opening 2*e* or the openings 2*c* and 2*d* may be formed in the base 2B.

What is claimed is:

1. A centrifuge assembly portion comprising:

a frame having a bottom portion;

a motor that is disposed in the frame to generate a driving force;

a output shaft that extends from the motor and that has an end positioned in proximity to the bottom portion;

a rotational shaft that is disposed in the frame and that has one end positioned in proximity to the bottom portion;

a belt that is supported on the end of the output shaft and the one end of the rotational shaft, wherein the bottom portion is formed with an opening that opposes at least part of the belt; and a removable cover adapted to cover the opening when access to one of the belt, output shaft and rotational shaft is not needed.

2. The centrifuge assembly portion according to claim 1, wherein the opening includes:

a first opening that opposes the one end of the rotational shaft; and a second opening that opposes the end of the output shaft.

3. The centrifuge assembly portion according to claim 2, wherein the opening includes a third opening that opposes an approximate center region between the one end of the rotational shaft and the end of the output shaft.

4. The centrifuge assembly portion according to claim 1, wherein the opening opposes an approximate center region between the one end of the rotational shaft and the end of the output shaft.

5. The centrifuge assembly portion according to claim 1, wherein the opening is formed to oppose an entire length of the belt.

6. The centrifuge assembly portion according to claim 1, comprising:

a bowl that is disposed in the frame and that defines a rotor chamber, the rotational shaft having another end positioned inside the bowl;

a rotor that is mounted on the another end of the rotational shaft;

a damper that is provided on the bottom portion;

a bearing that rotatably supports the rotational shaft; and a motor base supported on the bottom portion via the damper for supporting the motor and the bearing.

7. A centrifuge comprising:

a frame having a bottom portion;

a motor base supported on the bottom portion of the frame;

a motor that is disposed on the motor base and generates a rotational driving force;

an output shaft extending from the motor and having an end positioned in the proximity of the bottom portion of the frame;

a bowl disposed in the frame, which defines a rotor chamber;

a rotor disposed in the rotor chamber;

a rotational shaft extending from the rotor through a hole of the bowl and having an end positioned in the proximity of the bottom portion of the frame; and a belt supported on the end of the output shaft and the end of the rotational shaft to transmit the rotational driving force from the motor to the rotor;

wherein the bottom portion of the frame is formed with a first opening, a second opening and a third opening, the first opening being located adjacent to the end of the output shaft, the second opening being located adjacent to the end of the rotational shaft and the third opening being located adjacent to a part of the belt, and wherein a removable cover member is provided to cover the first, second and the third openings.

8. The centrifuge according to claim 7, wherein the third opening is located at an approximate center region of the bottom portion between the end of the rotational shaft and the end of the output shaft.

9. The centrifuge according to claim 7, wherein a damper is mounted on the bottom portion of the frame to support the motor base.

10. The centrifuge according to claim 9, wherein a plurality of dampers are arranged in a triangular shape on the bottom portion of the frame.

* * * * *